United States Patent [19]

Kosic

[11] 4,314,520

[45] Feb. 9, 1982

[54] STEERING MECHANISM FOR BOATS

[76] Inventor: Stjepan Kosic, Sveavägen 49, 113 59 Stockholm, Sweden

[21] Appl. No.: 140,787

[22] Filed: Apr. 16, 1980

[51] Int. Cl.[3] ..... B63H 25/00

[52] U.S. Cl. ..... 114/144 R

[58] Field of Search ..... 114/144 R, 144 E, 144 A; 244/196, 197, 221; 74/388 PS, 480 R, 480 B

[56] References Cited

U.S. PATENT DOCUMENTS

| | | | |
|---|---|---|---|
| 2,298,653 | 10/1942 | Scott-Paine et al. | 114/144 R |
| 2,362,178 | 11/1944 | Walker | 114/144 R |
| 3,138,133 | 6/1964 | Hatch | 114/144 R |
| 3,225,730 | 12/1965 | Blount | 114/144 R |
| 4,120,258 | 10/1978 | Spurgin | 114/144 E |
| 4,170,953 | 10/1979 | Pounder et al. | 74/388 PS |

*Primary Examiner*—Trygve M. Blix
*Assistant Examiner*—Jesus D. Sotelo
*Attorney, Agent, or Firm*—Hill, Van Santen, Steadman, Chiara & Simpson

[57] ABSTRACT

A steering mechanism for a boat comprises a support and a steering shaft which is rotatably mounted in the support and connected with a rudder operating device. A hand steering wheel is secured to one end of the steering shaft and a rotary power actuator is connected with the opposite end of the steering shaft through a self-locking reduction gear and a clutch. The clutch comprises a splined torque-transmitting member which is movable between an engaged and a disengaged position by a knob mounted on the steering wheel end of the steering shaft.

3 Claims, 1 Drawing Figure

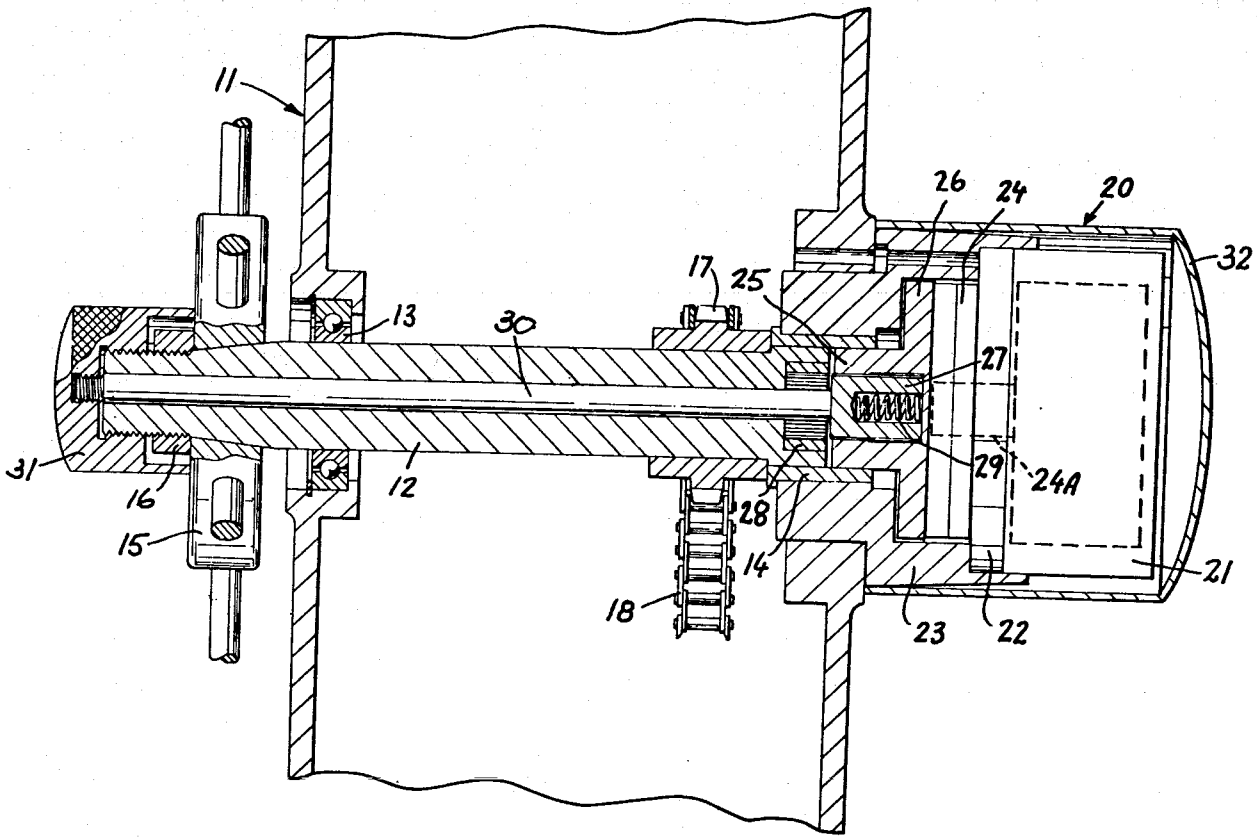
32
20
24
26
25
17
30
13
11
31
16
15
12
18
14
28
23
22
21
27
29
24A

STEERING MECHANISM FOR BOATS

BACKGROUND OF THE INVENTION

1. Field of the Invention

This invention relates to a steering mechanism for boats and more particularly to a steering mechanism of the type which may be operated by hand by means of a steering wheel or the like and by power by means of a power actuator controlled by hand or by an automatic pilot or the like.

Prior Art

Numerous embodiments of steering mechanisms of the above-described type are known. Illustrative examples are shown in U.S. Pat. Nos. 2,298,653, 2,362,178, 3,138,133 and 3,225,730. The prior art steering mechanisms generally are bulky and occupy valuable space or are not readily accessible for inspection, maintenance and repair. Moreover, the power actuator generally consumes considerable power because the power losses in the transmission between the motor of the power actuator and the rudder operating device are substantial.

SUMMARY OF THE INVENTION

The general object of the invention is to provide a steering mechanism which is suitable for use in sailboats or other boats in which power steering is desirable but in which only very limited power is available for steering because batteries or other power sources incapable of delivering ample power for extended periods have to be resorted to. It is also an object to provide a steering mechanism which is simple and which occupies only little space and can be mounted so as to be readily accessible for inspection, maintenance and repair.

According to the invention these and other objects are realized in a steering mechanism constructed in accordance with the claims.

The steering device according to the invention may be constructed from relatively few and small-sized components and may be mounted on the support structure which is required anyway for supporting the normal hand steering wheel and the associated steering shaft.

For a full understanding of the invention, an embodiment thereof is described hereinafter with reference to the accompanying drawing, the single FIGURE of which is a longitudinal cross-sectional view of a boat steering mechanism embodying the invention.

DETAILED DESCRIPTION

The steering mechanism comprises a support 11 which is only partially shown in the drawing. The support 11 is an upright tubular structure, the lower end of which may be secured to the deck of the boat, and the upper end of which may form or may support the binnacle of a magnetic compass (not shown). A horizontal tubular steering shaft 12 is rotatably mounted in a pair of bearings 13 and 14 on the support 11.

One end of the steering shaft 12 projects from the support 11 and carries a hand steering wheel 15 (only partially shown) which is secured to the steering shaft by a nut 16. A sprocket 17 is secured to the steering shaft 12 inside the tubular support 11 and forms part of a chain transmission, including a partially illustrated chain 18, serving to transmit rotational motion of the steering shaft 12 to a conventional rudder operating device (not shown).

When the steering shaft 12 is rotated in either direction, the rudder of the boat will be positively deflected in proportion to the angle of rotation of the steering shaft. The rotation of the steering shaft 12 may either be effected manually by turning the steering wheel 15 by hand, or it may be effected by power by means of a power actuator 20 controlled by an automatic pilot or the like (not shown). The power actuator 20 is mounted on the support 11 on the side thereof opposite to the steering wheel 15.

The power actuator 20 comprises an electric low-power, battery-operated rotary motor 21 secured through a flange 22 to a holder 23 which in turn is releasably attached to the support and mounts the bearing 14 which is a journal bearing. The shaft of the motor 21 is connected directly with the input or driving shaft 24A of a reduction gear 24, the output or driven shaft 25 of which is in the shape of a sleeve. The sleeve is journalled in the bearing 14 and is integral with a radial flange 26.

The reduction gear 24 has a gear ratio on the order of 200:1 and is of the harmonic speed changer type. Reduction gears of this type are available on the market under the trademark "Harmonic Drive" (United Machinery Corp.) and are characterized by being very compact in spite of the high gear ratio and by having its driving and driven shafts coaxial. They are also characterized by being self-locking, that is, the driving shaft cannot be rotated by applying torque to the driven shaft. The significance of the self-locking feature will become apparent as the description proceeds.

A clutch is operatively positioned between the driven shaft 25 of the reduction gear 24 and the adjacent end of the steering shaft 12. When engaged, the clutch forms a torque-transmitting connection between the driven shaft 25 and the steering shaft 12 so that the rotational motion of the motor is transmitted to the steering shaft with a speed reduction ratio of 200:1.

The clutch comprises an axially displaceable clutch member 27 provided with external splines by which it is in constant engagement with mating internal splines in the sleeve forming the driven shaft 25. A coaxial ring 28 secured to the adjacent end of the steering shaft 12 is provided with internal splines similar to the internal splines of the sleeve. Thus, upon axial displacement into the ring 28, the clutch member 27 will engage both the splines of the ring 28 and the splines of the shaft 25, thus rotatably uniting the driven shaft 25 of the reduction gear 24 with the steering shaft 12.

The clutch member 27 is displaceable axially between a disengaged position in which its splines engage only the splines of the shaft 25—the disengaged position is the position shown in the drawing—so that the steering shaft 12 can be rotated independently of the shaft 25, and an engaged position, in which its splines engage the splines of both the shaft 25 and the ring 28. The displacement to the engaged position is effected by a compression spring 29 constantly biasing the clutch member 27 towards the steering shaft 12. The displacement of the clutch member 27 to the disengaged position is effected by means of a rod 30 extending coaxially through the steering shaft 12. A control member in the form of a knob 31 is secured to the rod and threadedly engaged with the steering shaft 12. Thus, by turning the knob 31 in one direction, the clutch member 27 may be displaced to the disengaged position, and by turning the knob in the opposite direction, the clutch member may be permitted to move to the engaged position under the influence of the spring 29.

The power actuator 20 is enclosed in a sealed cap 32 which is removably attached to the support 11.

If the boat is to be steered by hand, the clutch is positioned in the disengaged position so that the steering shaft 12 may be rotated by means of the steering wheel 15 without any part of the power actuator 20 being moved. In this regard, the steering mechanism according to the invention differs favorably from many prior art steering mechanisms in which at least a part of the transmission associated with the power actuator has to be rotated even during hand steering.

When steering by the autopilot is desired, the knob 31 is turned outwardly on the steering shaft 12 so that the clutch is engaged. The steering shaft 12 may then be rotated exclusively by the motor 31 through the reduction gear 24; because of the self-locking property of the reduction gear, the steering shaft can no longer be rotated by means of the steering wheel 15. Due to the high gear ratio of the reduction gear 24, the low-power motor 21 is capable of applying a sufficient torque to the steering shaft 12.

The self-locking feature of the reduction gear and the mechanical actuation of the clutch are also advantageous in that they permit locking of the steering shaft 12 without electrical power consumption and without requiring a separate mechanical locking device. If, when the automatic pilot is disconnected, it is desired to lock the rudder by locking the steering shaft 12, all that needs be done is to place the clutch in the engaged position.

The steering mechanism according to the invention is also advantageous in that it can fairly easily be installed on existing boats. As evident from the drawing, the steering shaft and the support in which the steering shaft is rotatably journalled may be constructed such that the boat may be delivered with the power actuator 20 and the automatic pilot omitted but with the illustrated locking feature for the steering shaft included. If desired, the boat can then later be equipped with the power actuator (and the automatic pilot) without any substantial modifications of the existing structure being necessary.

The gear ratio of the reduction gear is not critical as long as it is sufficient to enable the motor to apply the required torque to the steering shaft through the reduction gear. However, it is preferred to have a relatively high gear ratio, i.e. on the order of 50:1 or higher, because a lower gear ratio will often necessitate the use of a more powerful and large-sized motor than is consistent with the requirement for low power comsumption and small overall dimensions of the steering mechanism.

What I claim is:

1. A steering mechanism for boats, comprising (a) a support, (b) a steering shaft rotatably mounted in the support, (c) means for transmitting rotational motion of the steering shaft to a rudder operating device, (d) a hand steering wheel secured to one end of the steering shaft, and (e) a power actuator mounted on the support adjacent to the opposite end of the steering shaft and comprising (i) a rotary motor, (ii) a self-locking reduction gear with high gear ratio and including a driving shaft connected to the motor and a driven shaft coaxial with the driving shaft and the steering shaft, and (iii) a clutch operatively positioned between the driven shaft of the reduction gear and said opposite end of the steering shaft, said clutch having a torque transmitting member coaxial with the driving shaft, the driven shaft and the steering shaft and being axially displaceable between an engaged position and a disengaged position, said torque transmitting member in said engaged position rotationally uniting the steering and driven shafts and in said disengaged position permitting relative rotation of the steering and driven shafts.

2. A steering mechanism as claimed in claim 1 including an operating member for the torque transmitting member extending axially through the steering shaft, and a manually operable control member mounted on the steering shaft adjacent to the steering wheel, said operating member being axially displaceable by manipulation of said control member.

3. A steering mechanism as claimed in claim 2, said torque transmitting member being axially displaceable in one direction by means of the operating member and being spring-biased in the opposite direction.

* * * * *